US006698040B1

(12) United States Patent
Acevedo

(10) Patent No.: US 6,698,040 B1
(45) Date of Patent: Mar. 2, 2004

(54) RETRACTABLE BED

(76) Inventor: Oscar Acevedo, 532 Johnston St., Perth Amboy, NJ (US) 08861

( * ) Notice: Subject to any disclaimer, the term of this patent is extended or adjusted under 35 U.S.C. 154(b) by 0 days.

(21) Appl. No.: 10/198,907

(22) Filed: Jul. 19, 2002

(51) Int. Cl.[7] ..... A47C 17/00
(52) U.S. Cl. ..... 5/10.2; 5/10.1
(58) Field of Search ..... 5/10.1, 10.2

(56) References Cited

U.S. PATENT DOCUMENTS

| | | | | | |
|---|---|---|---|---|---|
| 1,819,516 | A | * | 8/1931 | Kelly | 5/10.2 X |
| 1,945,875 | A | * | 2/1934 | Woller | 5/10.2 |
| 1,965,370 | A | * | 7/1934 | Cohn | 5/10.2 |
| 2,052,790 | A | * | 9/1936 | Norton | 5/10.2 |
| 2,526,562 | A | * | 10/1950 | Kelly, Jr. et al. | 5/10.2 |
| 2,968,048 | A | | 1/1961 | Roberge | |
| 3,028,606 | A | | 4/1962 | Boutet | |
| 3,494,656 | A | * | 2/1970 | McIntire | 5/10.1 X |
| 3,829,912 | A | * | 8/1974 | Quakenbrush | 5/10.2 |
| 3,882,554 | A | | 5/1975 | Glass | |
| 4,058,860 | A | | 11/1977 | Daidone | |
| 4,853,989 | A | * | 8/1989 | Garcia | 5/10.2 |
| 5,461,735 | A | * | 10/1995 | Danton | 5/10.2 |
| D379,877 | S | | 6/1997 | Tilley | |
| 5,638,559 | A | * | 6/1997 | Natri et al. | 5/10.2 |
| 5,943,714 | A | | 8/1999 | Dignam | |

* cited by examiner

*Primary Examiner*—Teri Pham Luu

(57) ABSTRACT

A retractable bed for mounting in a ceiling of a room. The retractable bed includes a cap member for mounting on mounting rafters of a framed section in a ceiling and has a cap cavity. The cap member comprises a top wall, and a pair of cap side walls and cap end walls that are attached to and extend away from the top wall to define the cap cavity. A base member holds a bed and in a bed cavity. The base member comprises a bottom wall, and a pair of base side walls and base end walls being attached to and extending away from the bottom wall to define the bed cavity. The base member is selectively positionable in the cap cavity. A moving means selectively moves the base member between a retracted position and an extended position. A switch allows a user to actuate the moving means, thereby controlling the positioning of the bed.

20 Claims, 8 Drawing Sheets

RETRACTABLE BED

BACKGROUND OF THE INVENTION

1. Field of the Invention

The present invention relates to storable bed systems and more particularly pertains to a new retractable bed for mounting in a ceiling of a room.

2. Description of the Prior Art

The use of storable bed systems is known in the prior art. U.S. Pat. No. 2,968,048 describes a hoist for beds. Another type of storable bed system is U.S. Pat. No. 5,943,714 which discloses a suspend sleeping platform assembly for suspending a bed from a ceiling.

While these devices fulfill their respective, particular objectives and requirements, the need remains for a system in which the bed is stored above ceiling level until needed, then remotely lowered into a position allowing a user to access the bed.

SUMMARY OF THE INVENTION

The present invention meets the needs presented above by incorporating hydraulic telescoping sections in conjunction with a hydraulic power assembly being operationally coupled to a cap member mounted in the ceiling and a base member supporting the bed which is positionable within a cavity in the cap member during storage, and is extendable downward for accessibility to the user by means of a control switch conveniently located within the room.

An object of the present invention is to provide a new retractable bed that is fully hidden within the attic when not in use in a cap member, which allows the user to leave the bedding on the bed when stored.

Another object of the present invention is to provide a new retractable bed that saves floor space in the room in which it is installed.

To this end, the present invention generally comprises a cap member for mounting on mounting rafters of a framed section in a ceiling and has a cap cavity. The cap member comprises a top wall, and a pair of cap side walls and cap end walls that are attached to and extend away from the top wall to define the cap cavity. A base member holds a bed and in a bed cavity. The base member comprises a bottom wall, and a pair of base side walls and base end walls being attached to and extending away from the bottom wall to define the bed cavity. The base member is selectively positionable in the cap cavity. A moving means selectively moves the base member between a retracted position and an extended position. A switch allows a user to actuate the moving means, thereby controlling the positioning of the bed.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
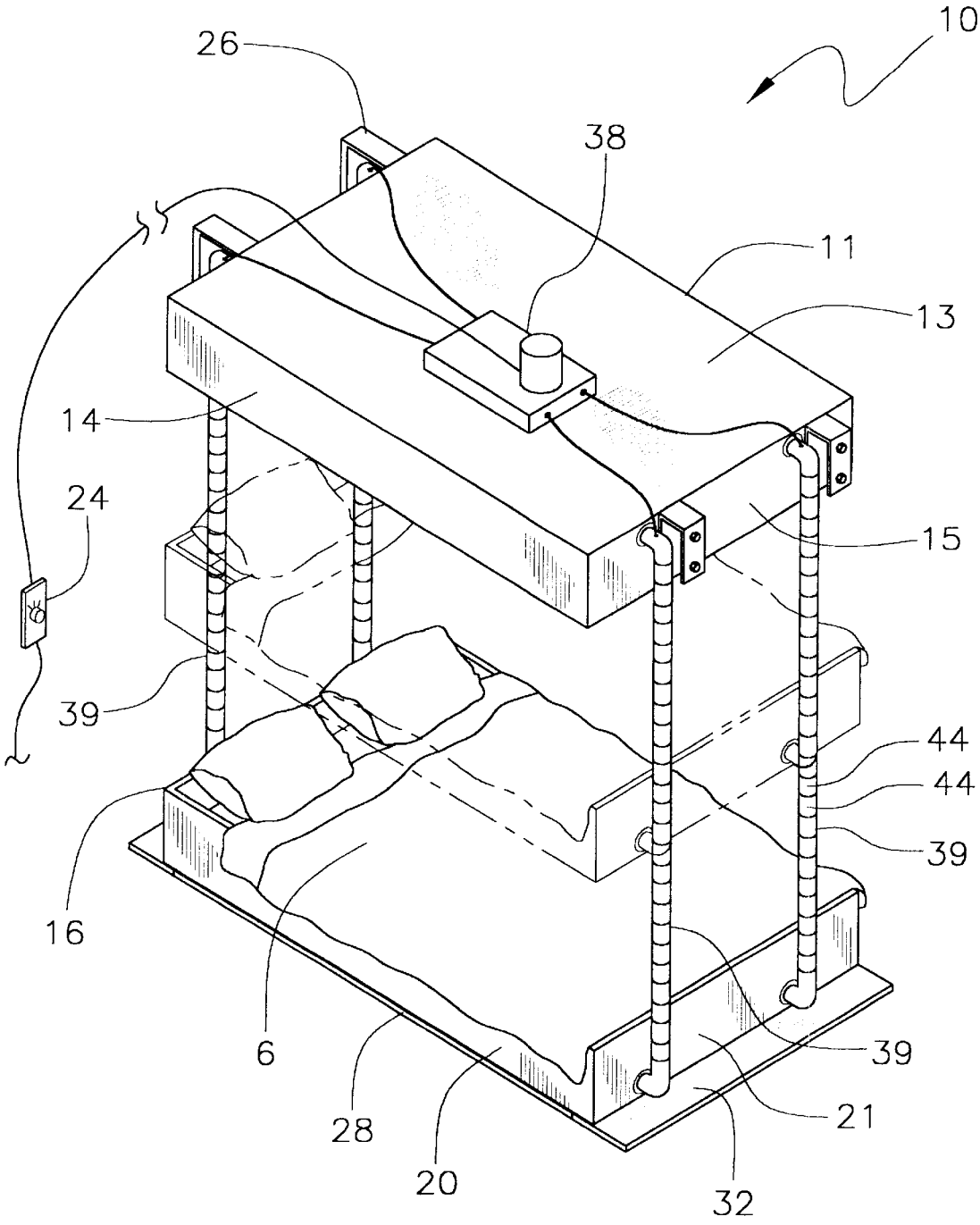
FIG. 1 is a schematic perspective view of a new retractable bed according to the present invention with the bed in place and depicting it in between the retracted and extended positions.
Figure 2:
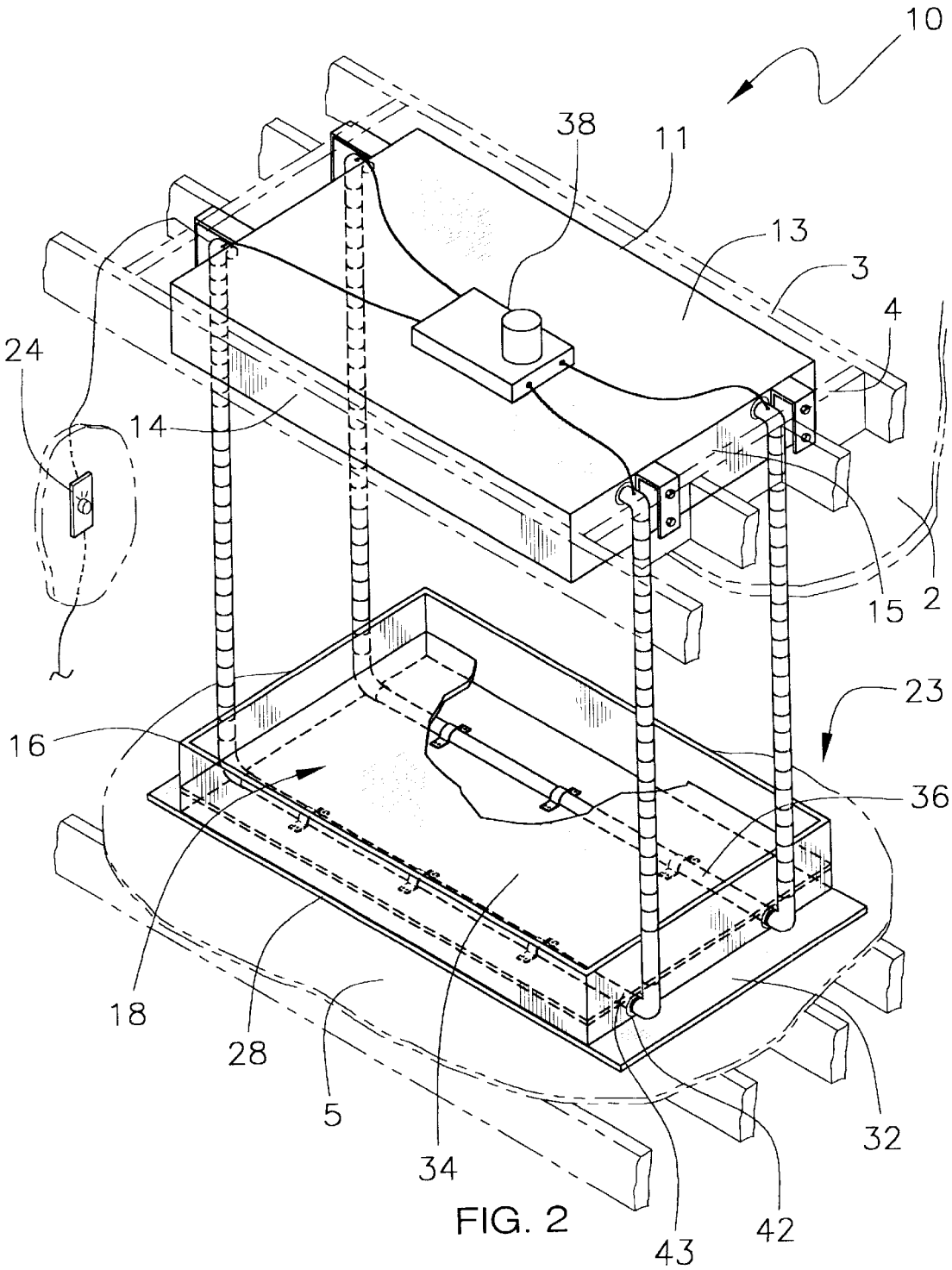
FIG. 2 is a schematic perspective view of the present invention.
Figure 3:
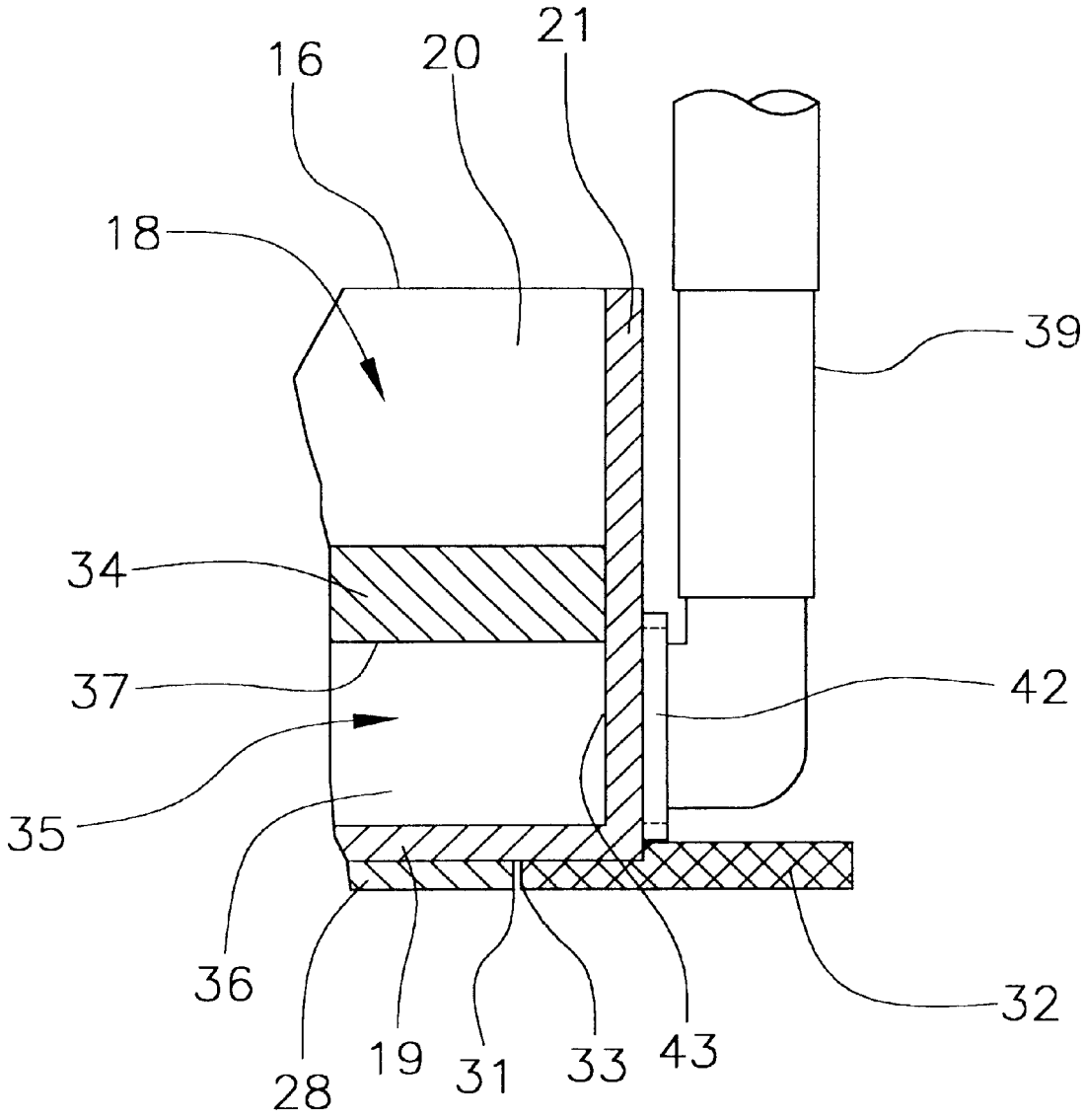
FIG. 3 is a schematic side cross-sectional view of a lower corner section of the base member of the present invention.
Figure 4:
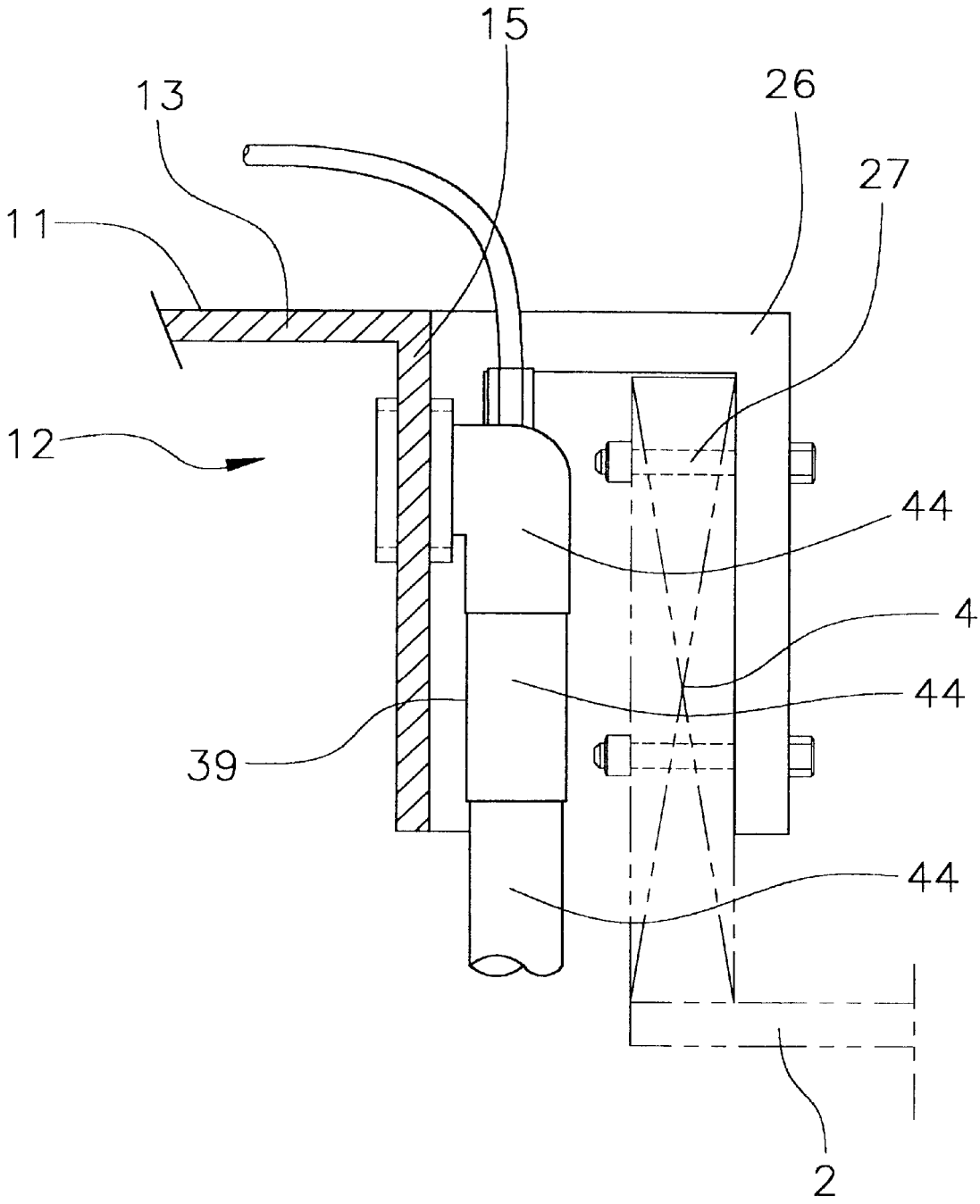
FIG. 4 is a schematic side partial cross-sectional view of an upper corner section of the present invention.
Figure 5:
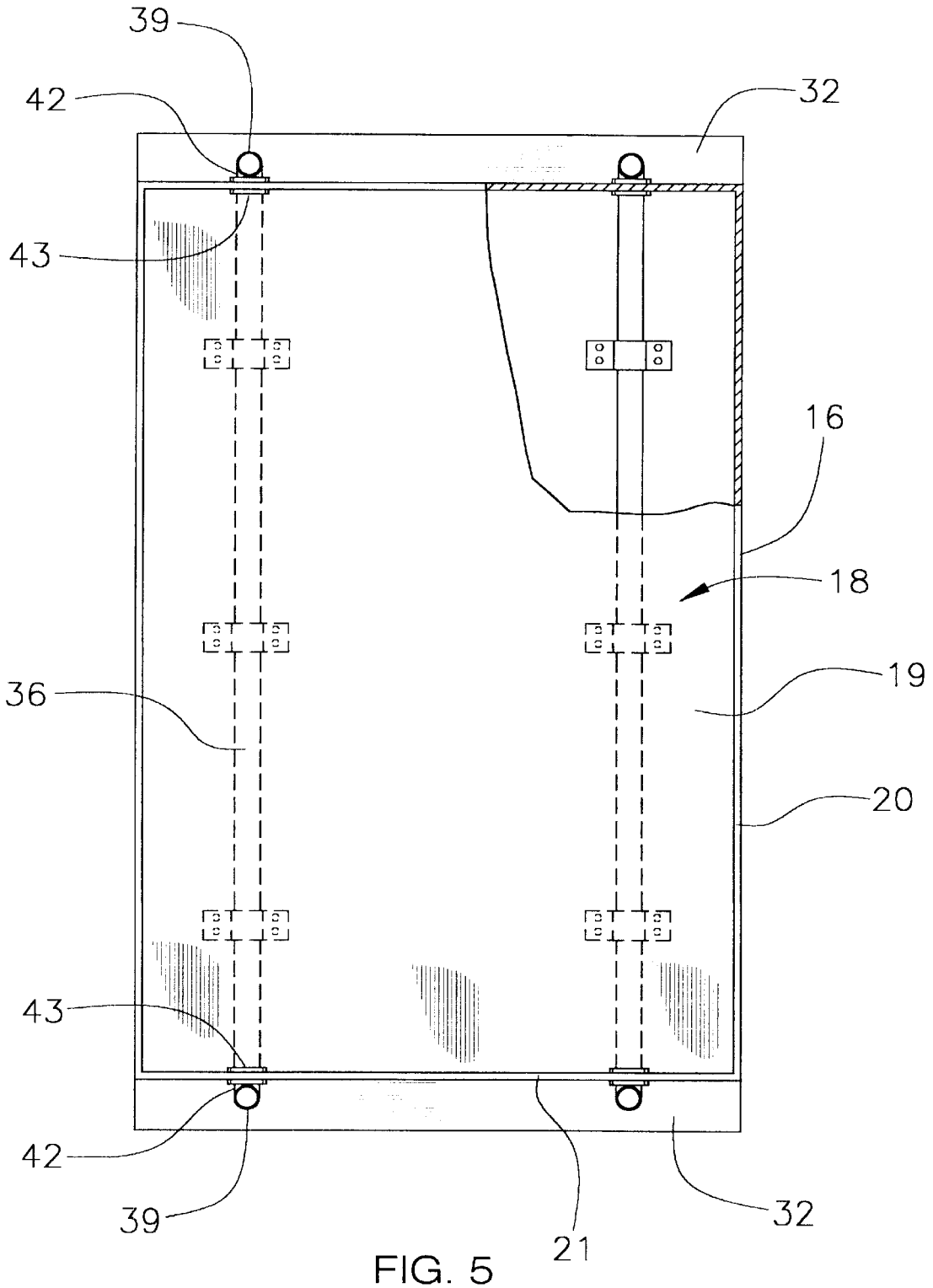
FIG. 5 is a schematic cutaway view of the base member of the present invention from a top perspective looking down.
Figure 6:
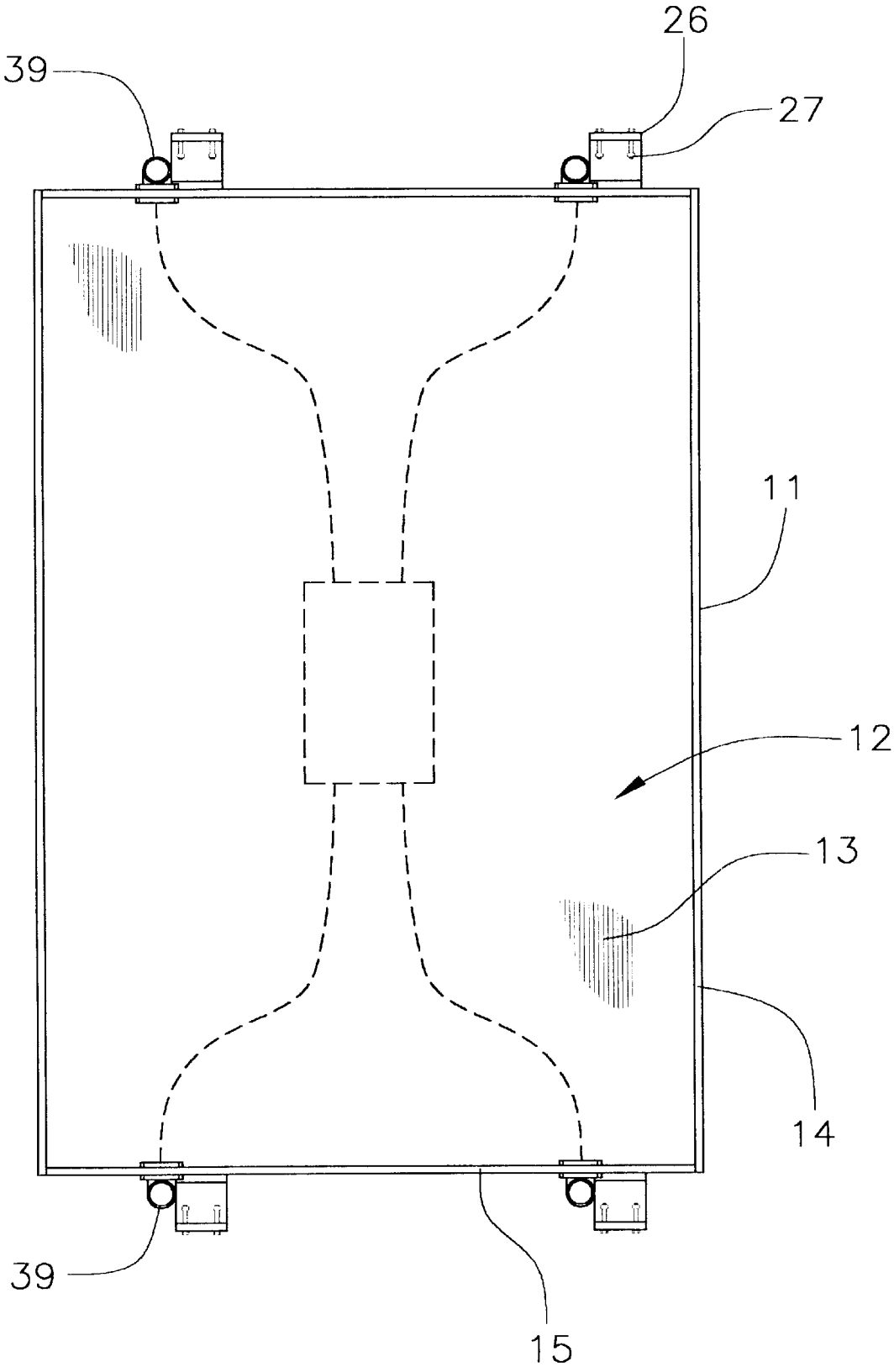
FIG. 6 is a schematic bottom view of the cap member of the present invention from a bottom perspective looking up.
Figure 7:
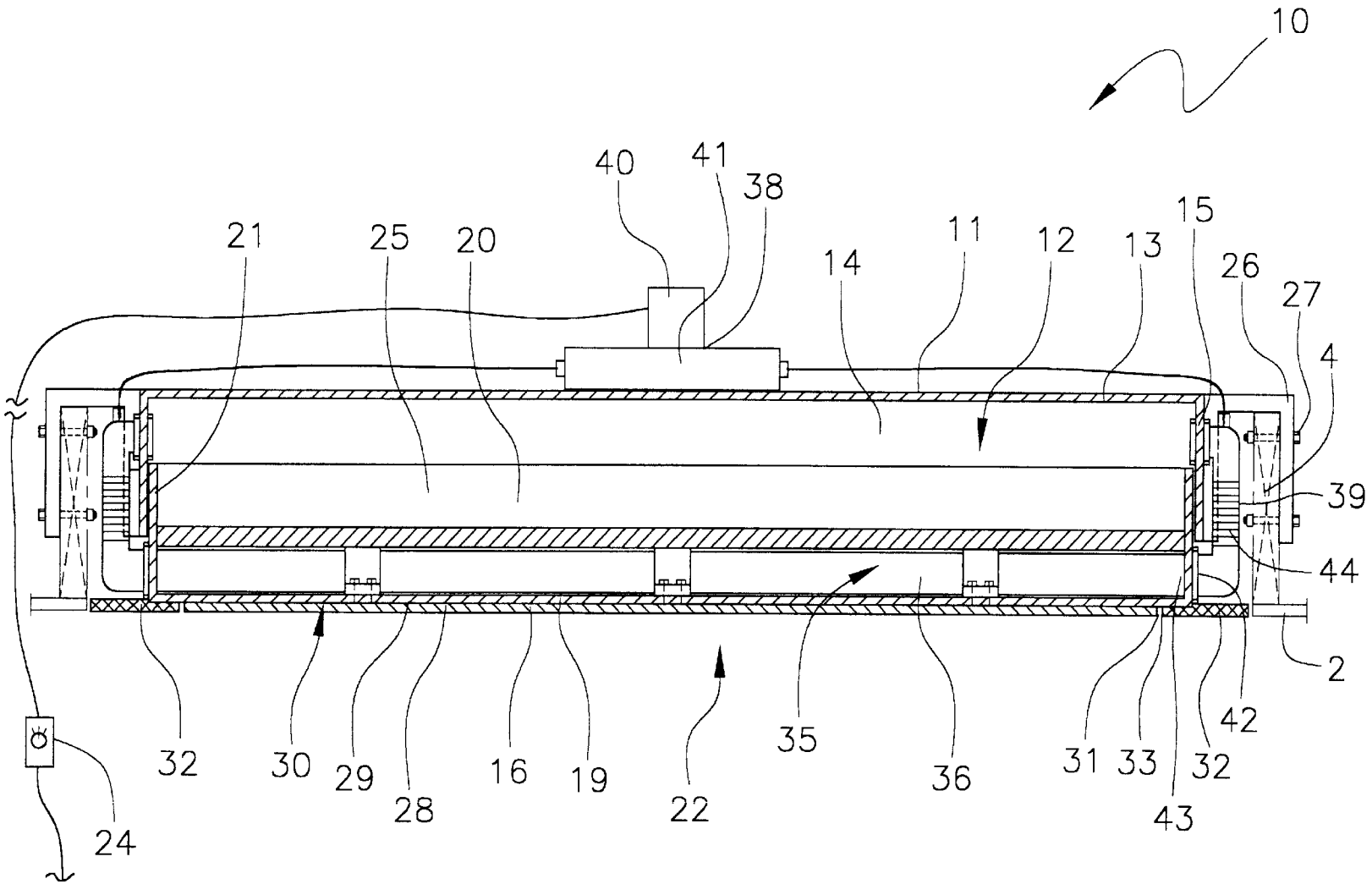
FIG. 7 is a schematic side cross-sectional view of the present invention in the fully retracted position
Figure 8:
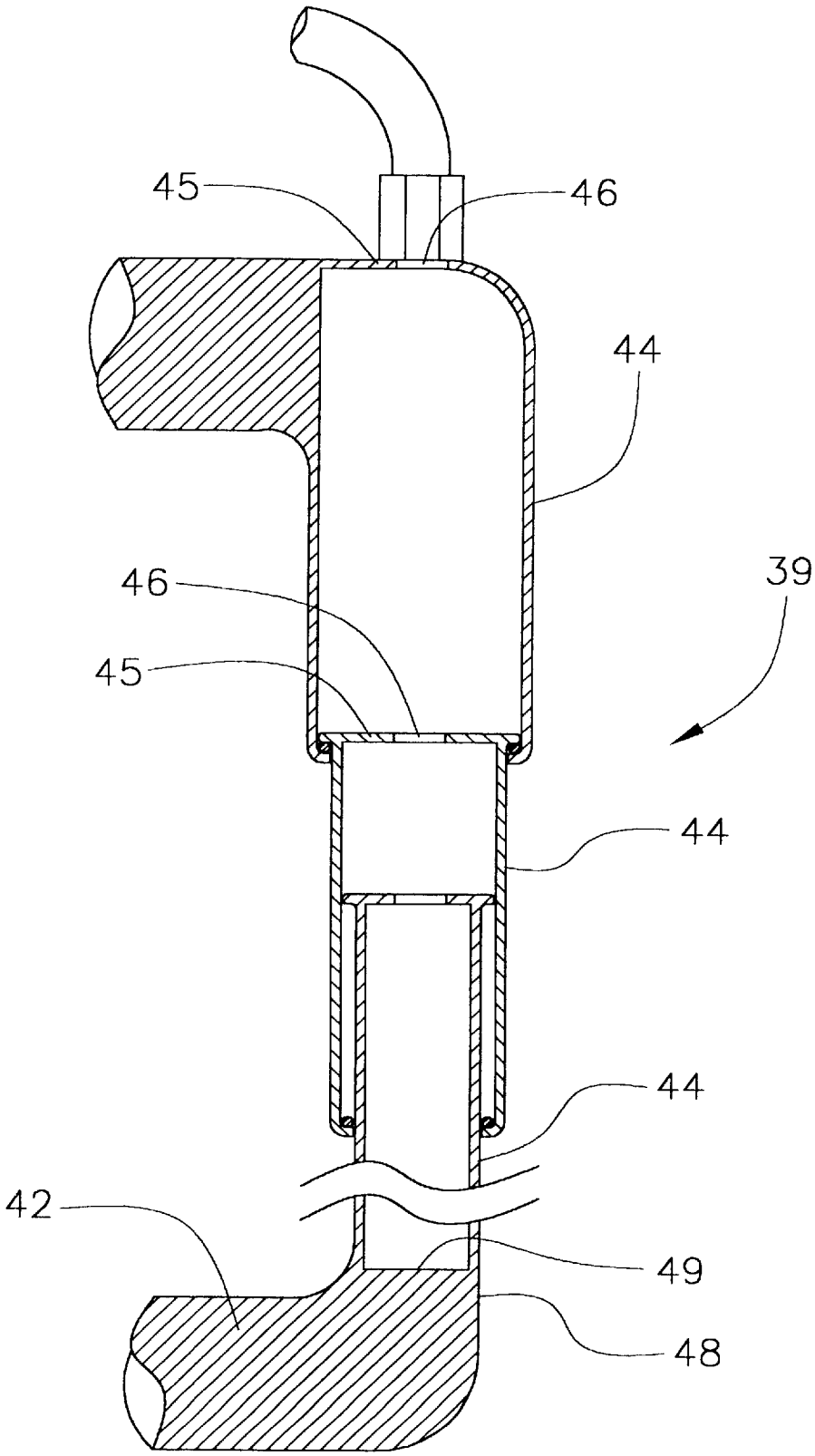
FIG. 8 is a schematic partial side cross-sectional view of a cylinder assembly of the present invention.

With reference now to the drawings, and in particular to FIGS. 1 through 8 thereof, a new retractable bed embodying the principles and concepts of the present invention and generally designated by the reference numeral 10 will be described.

As best illustrated in FIGS. 1 through 8, the retractable bed 10 generally comprises a cap member 11 for mounting on mounting rafters 4 of a framed section 3 in a ceiling 2 of a room and has a cap cavity 12. The cap member 11 comprises a top wall 13, and a pair of cap side walls 14 and cap end walls 15 that are attached to and extend away from the top wall 13 to define the cap cavity 12.

A base member 16 holds a bed 6 and has a bed cavity 18. The base member 16 comprises a bottom wall 19, and a pair of base side walls 20 and base end walls 21 that are attached to and extend away from the bottom wall 19 to define the bed cavity 18. The base member 16 is selectively positionable in the cap cavity 12.

A moving means selectively moves the base member 16 between a retracted position 22 and an extended position 23. A switch 24 actuates the moving means.

The base member 16 being fully received by the cap member 11 such that the base member 16 is flush with the ceiling 2 characterizes the retracted position 22. The base member 16 being positioned generally adjacent to a floor 5 of the room so as to allow access to the bed 6 characterizes the extended position 23.

The cap member 11 and the base member 16 have generally the same shape. Dimensions of the base member 16 are generally smaller than dimensions of the cap member 11 such that an uppermost portion 25 of the base member 16 is positionable in the cap cavity 12.

A plurality of U-shaped mounting brackets 26 selectively couples the cap member 11 to the mounting rafters 4. Each of the mounting brackets 26 is attached to the cap end walls 15 of the cap member 11. Each of the mounting brackets 26 includes a plurality of fasteners 27 for securely coupling the cap member 11 to the mounting rafters 4.

The base member 16 includes a ceiling plate 28 for creating a false ceiling on a bottom side 29 of the base member 16. The ceiling plate 28 is mounted on an outer surface 30 of the bottom wall 19 and comprises a material being generally similar to the ceiling 2 of the room.

The ceiling plate 28 has a width is generally equal to the bottom wall 19 and a length that is generally less than a length of the bottom wall 19 such that end edges 31 of the ceiling plate 28 are recessed away from the base end walls 21.

A pair of flap members 32 is attached to and protrudes outward from the base end walls 21 of the base member 16. Each of the flap members 32 extends a full width of the bottom wall 19 and has an inner edge 33 that abut the end edges 31 of the ceiling plate 28.

A distance between outer edges of the flap members 32 when each of the flap members 32 is mounted on the base member 16 is generally equal to a distance between the mounting rafters 4 of the ceiling 2.

Each of the flap members 32 comprises a generally resilient elastomeric material.

A support wall 34 for supporting the bed 6 is attached to and extends between the base side walls 20 and the base end walls 21. The support wall 34 is positioned proximate to the bottom wall 19 and is oriented substantially parallel to the bottom wall 19 to define a base cavity 35 between the bottom wall 19 and the support wall 34.

A plurality of elongate support members 36 for supporting the base member 16 is located in the base cavity 35. Each of the support members 36 is attached to and extends between the base end walls 21 in a substantially parallel manner.

Each of the support members 36 is attached to the bottom wall 19 of the base member 16. Each of the support members 36 abuts a lower surface 37 of the support wall 34 for the purpose of supplying additional bearing support.

The moving means comprises a pump assembly 38 and a plurality of telescoping cylinder assemblies 39. The pump assembly 38 comprises a hydraulic pump member 40 has a reservoir 41. The pump member 40 is electrically coupled to the switch 24. The pump assembly 38 is fluidly coupled to each of the cylinder assemblies 39.

Activation of the pump assembly 38 in a first direction forces fluid from the reservoir 41 into each of the cylinder assemblies 39 causing each of the cylinder assemblies 39 to extend. Activation of the pump assembly 38 in a second direction forces the fluid from each of the cylinder assemblies 39 into the reservoir 41 causing each of the cylinder assemblies 39 to retract.

Each of the cylinder assemblies 39 is attached to and extends between each of the cap side walls 14 and each of the base side walls 20.

A bottom end 42 of each of the cylinder assemblies 39 is coupled to respective ends 43 of each of the support members 36.

When each of the cylinder assemblies 39 is fully extended, the base member 16 is in the extended position 23. When each of the cylinder assemblies 39 is fully retracted, the base member 16 is in the retracted position 22.

Each of the cylinder assemblies 39 comprises a plurality of cylinder members 44. Each of the cylinder members 44 includes a piston wall 45 that has an aperture 46 extending therethrough such that each of the cylinder members 44 is in fluid communication with each other. A bottommost cylinder member 48 of each of said cylinder assemblies 39 having a closed end 49 such that each of said cylinder assemblies 39 is a fluidly closed system. Each of the cylinder members 44 is telescoping such that a length of each of the cylinder assemblies 39 is variable.

The switch 24 is positioned in the room so as to allow a user to actuate the pump assembly 38 while observing movement of the base member 16 from a safe distance and allowing the user to observe all areas beneath the base member 16 for safety purposes. The switch 24 is electrically coupled to a power source.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A retractable bed system for mounting in a ceiling of a room, wherein the ceiling has a framed section including a plurality of mounting rafters, said bed system comprising:

a cap member for mounting on mounting rafters of a framed section in a ceiling and having a cap cavity, said cap member comprising a top wall, and a pair of cap side walls and cap end walls being attached to and extending away from said top wall defining said cap cavity;

a base member for holding a bed and having a bed cavity, said base member comprising a bottom wall, and a pair of base side walls and base end walls being attached to and extending away from said bottom wall defining said bed cavity, said base member being selectively positionable in said cap cavity;

a moving means for selectively moving said base member between a retracted position and an extended position;

a switch for actuating said moving means;

said base member including a ceiling plate for creating a false ceiling on a bottom side of said base member, said ceiling plate being mounted on an outer surface of said bottom wall and comprising a material being generally similar to the ceiling of the room; and said ceiling plate having a width being generally equal to said bottom wall and a length being generally less than a length of said bottom wall such that end edges of said ceiling plate are recessed away from said base end walls.

2. The retractable bed system as set forth in claim 1, wherein said retracted position is characterized by said base member being fully received by said cap member such that said base member is flush with the ceiling, and said extended position is characterized by said base member being positioned generally adjacent to a floor of a room so as to allow access to the bed.

3. The retractable bed system as set forth in claim 1, further comprising said cap member and said base member having generally the same shape, wherein dimensions of said base member are generally smaller than dimensions of said cap member such that an uppermost portion of said base member is positionable in said cap cavity.

4. The retractable bed system as set forth in claim 1, further comprising a plurality of U-shaped mounting brackets for selectively coupling said cap member to the mounting rafters, each of said mounting brackets being attached to said cap end walls of said cap member, each of said mounting brackets including a plurality of fasteners for securely coupling said cap member to the mounting rafters.

5. The retractable bed system as set forth in claim 1, further comprising a pair of flap members being attached to and protruding outwardly from said base end walls of said base member, each of said flap members extending a full width of said bottom wall and having an inner edge abutting said end edges of said ceiling plate.

6. The retractable bed system as set forth in claim 5, wherein a distance between outer edges of said flap members when each of said flap members is mounted on said base member is generally equal to a distance between the mounting rafters of the ceiling.

7. The retractable bed system as set forth in claim 5, further comprising each of said flap members comprising a generally resilient elastomeric material.

8. The retractable bed system as set forth in claim 1, further comprising a support wall for supporting the bed, said support wall being attached to and extending between said base side walls and said base end walls, said support wall being positioned proximate to said bottom wall and being oriented substantially parallel to said bottom wall to define a base cavity between said bottom wall and said support wall.

9. The retractable bed system as set forth in claim 8, further comprising a plurality of elongate support members for supporting said base member and being located in said base cavity, each of said support members being attached to and extending between said base end walls in a substantially parallel manner.

10. The retractable bed system as set forth in claim 9, further comprising each of said support members being attached to said bottom wall of said base member, each of said support members abutting a lower surface of said support wall for the purpose of supplying additional bearing support.

11. The retractable bed system as set forth in claim 1, further comprising said moving means comprising a pump assembly and a plurality of telescoping cylinder assemblies, said pump assembly comprising a hydraulic pump member having a reservoir, said pump member being electrically coupled to said switch, said pump assembly being fluidly coupled to each of said cylinder assemblies.

12. The retractable bed system as set forth in claim 11, wherein activation of said pump assembly in a first direction forces fluid from said reservoir into each of said cylinder assemblies causing each of said cylinder assemblies to extend, and activation of said pump assembly in a second direction forces the fluid from each of said cylinder assemblies into said reservoir causing each of said cylinder assemblies to retract.

13. The retractable bed system as set forth in claim 11, further comprising each of said cylinder assemblies being attached to and extending between each of said cap side walls and each of said base side walls.

14. The retractable bed system as set forth in claim 11, further comprising a bottom end of each of said cylinder assemblies being coupled to respective ends of each of a plurality of support members.

15. The retractable bed system as set forth in claim 1, wherein when each of said cylinder assemblies is fully extended, said base member is in said extended position, and when each of said cylinder assemblies is fully retracted, said base member is in said retracted position.

16. The retractable bed system as set forth in claim 11, further comprising each of said cylinder assemblies comprising a plurality of cylinder members, each of said cylinder members including a piston wall having an aperture extending therethrough such that each of said cylinder members is in fluid communication with each other;

a bottommost cylinder member of each of said cylinder assemblies having a closed end such that each of said cylinder assemblies is a fluidly closed system; and each of said cylinder members being telescoping such that a length of each of said cylinder assemblies is variable.

17. The retractable bed system as set forth in claim 11, further comprising said switch being positioned in the room so as to allow a user to actuate said pump assembly while observing movement of said base member from a safe distance and allowing the user to observe all areas beneath said base member for safety purposes, said switch being electrically coupled to a power source.

18. The retractable bed system as set forth in claim 1, further comprising:

wherein said retracted position is characterized by said base member being fully received by said cap member such that said base member is flush with the ceiling, and said extended position is characterized by said base member being positioned generally adjacent to a floor of a room so as to allow access to the bed;

said cap member and said base member having generally the same shape, wherein dimensions of said base member are generally smaller than dimensions of said cap member such that an uppermost portion of said base member is positionable in said cap cavity;

a plurality of U-shaped mounting brackets for selectively coupling said cap member to the mounting rafters, each of said mounting brackets being attached to said cap end walls of said cap member, each of said mounting brackets including a plurality of fasteners for securely coupling said cap member to the mounting rafters;

a pair of flap members being attached to and protruding outwardly from said base end walls of said base member, each of said flap members extending a full width of said bottom wall and having an inner edge abutting said end edges of said ceiling plate;

wherein a distance between outer edges of said flap members when each of said flapmembers is mounted on said base member is generally equal to a distance between the mounting rafters of the ceiling;

each of said flap members comprising a generally resilient elastomeric material;

a support wall for supporting the bed, said support wall being attached to and extending between said base side walls and said base end walls, said support wall being positioned proximate to said bottom wall and being oriented substantially parallel to said bottom wall to define a base cavity between said bottom wall and said support wall;

a plurality of elongate support members for supporting said base member and being located in said base cavity, each of said support members being attached to and extending between said base end walls in a substantially parallel manner;

each of said support members being attached to said bottom wall of said base member, each of said support members abutting a lower surface of said support wall for the purpose of supplying additional bearing support;

said moving means comprising a pump assembly and a plurality of telescoping cylinder assemblies, said pump assembly comprising a hydraulic pump member having a reservoir, said pump member being electrically coupled to said switch, said pump assembly being fluidly coupled to each of said cylinder assemblies;

wherein activation of said pump assembly in a first direction forces fluid from said reservoir into each of said cylinder assemblies causing each of said cylinder assemblies to extend, and activation of said pump assembly in a second direction forces the fluid from each of said cylinder assemblies into said reservoir causing each of said cylinder assemblies to retract;

each of said cylinder assemblies being attached to and extending between each of said cap side walls and each of said base side walls;

a bottom end of each of said cylinder assemblies being coupled to respective ends of each of said support members;

wherein when each of said cylinder assemblies is fully extended, said base member is in said extended position, and when each of said cylinder assemblies is fully retracted, said base member is in said retracted position;

each of said cylinder assemblies comprising a plurality of cylinder members, each of said cylinder members including a piston wall having an aperture extending therethrough such that each of said cylinder members is in fluid communication with each other, each of said cylinder members being telescoping such that a length of each of said cylinder assemblies is variable; and said switch being positioned in the room so as to allow a user to actuate said pump assembly while observing movement of said base member from a safe distance and allowing the user to observe all areas beneath said base member for safety purposes, said switch being electrically coupled to a power source.

19. A retractable bed system for mounting in a ceiling of a room, wherein the ceiling has a framed section including a plurality of mounting rafters, said bed system comprising:

a cap member for mounting on mounting rafters of a framed section in a ceiling and having a cap cavity, said cap member comprising a top wall, and a pair of cap side walls and cap end walls being attached to and extending away from said top wall defining said cap cavity;

a base member for holding a bed and having a bed cavity, said base member comprising a bottom wall, and a pair of base side walls and base end walls being attached to and extending away from said bottom wall defining said bed cavity, said base member being selectively positionable in said cap cavity;

a moving means for selectively moving said base member between a retracted position and an extended position;

a switch for actuating said moving means;

a support wall for supporting the bed, said support wall being attached to and extending between said base side walls and said base end walls, said support wall being positioned proximate to said bottom wall and being oriented substantially parallel to said bottom wall to define a base cavity between said bottom wall and said support wall; and a plurality of elongate support members for supporting said base member and being located in said base cavity, each of said support members being attached to and extending between said base end walls in a substantially parallel manner.

20. A retractable bed system for mounting in a ceiling of a room, wherein the ceiling has a framed section including a plurality of mounting rafters, said bed system comprising:

a cap member for mounting on mounting rafters of a framed section in a ceiling and having a cap cavity, said cap member comprising a top wall, and a pair of cap side walls and cap end walls being attached to and extending away from said top wall defining said cap cavity;

a base member for holding a bed and having a bed cavity, said base member comprising a bottom wall, and a pair of base side walls and base end walls being attached to and extending away from said bottom wall defining said bed cavity, said base member being selectively positionable in said cap cavity;

a moving means for selectively moving said base member between a retracted position and an extended position;

a switch for actuating said moving means; and said moving means comprising a pump assembly and a plurality of telescoping cylinder assemblies, said pump assembly comprising a hydraulic pump member having a reservoir, said pump member being electrically coupled to said switch, said pump assembly being fluidly coupled to each of said cylinder assemblies.

* * * * *